United States Patent [19]

Luray

[11] Patent Number: 4,606,459

[45] Date of Patent: Aug. 19, 1986

[54] PROTECTIVE PACKAGING

[76] Inventor: Howard L. Luray, 15730 Beach Dr. Northeast, Seattle, Wash. 98155

[21] Appl. No.: 660,581

[22] Filed: Oct. 15, 1984

[51] Int. Cl.[4] ..... B65D 81/02

[52] U.S. Cl. ..... 206/583; 206/485

[58] Field of Search ..... 206/583, 521, 522, 488

[56] References Cited

U.S. PATENT DOCUMENTS

| | | | |
|---|---|---|---|
| 2,501,570 | 3/1950 | Larsen | 206/46 |
| 2,837,208 | 6/1958 | Lingenfelter | 206/46 |
| 2,956,672 | 12/1958 | Kirkpatrick | 206/46 |
| 3,752,301 | 8/1973 | Bluemel | 206/46 FR |
| 3,853,220 | 12/1974 | Luray | 206/466 |

FOREIGN PATENT DOCUMENTS

| | | | |
|---|---|---|---|
| 2723175 | 11/1978 | Fed. Rep. of Germany | 206/583 |
| 135796 | 11/1978 | Fed. Rep. of Germany | 206/583 |
| 8300175 | 9/1983 | PCT Int'l Appl. | 206/583 |
| 237322 | 7/1925 | United Kingdom . | |
| 827346 | 5/1981 | U.S.S.R. | 206/583 |

*Primary Examiner*—Joseph Man-Fu Moy

*Attorney, Agent, or Firm*—Ward Brown; Robert W. Beach

[57] ABSTRACT

A fragile article is enclosed in the central portion of an elongated shock-absorbing cradle supported only at its ends by connection of tabs which, in turn, are swingably connected to the opposite ends of a rectangular insert ring. The tabs are swingable or bendable relative to such insert ends, first outward and then toward the outer sides of such ends, so as to place the central portion of the cradle under tension. The insert is fitted closely inside a rigid outer box for shipment, such box being of a size to retain the tabs in their positions tensioning the central portion of the cradle.

11 Claims, 11 Drawing Figures

PROTECTIVE PACKAGING

BACKGROUND OF THE INVENTION

1. Field of the Invention

The present invention relates to special packaging for a fragile article and, more specifically, to the general type of package which includes an outer box and a hammock or cradle extending inside the box and supporting the fragile article.

2. Prior Art

In the package disclosed in Larsen U.S. Pat. No. 2,501,570, a fragile article to be packaged is sandwiched between upper and lower flexible thermoplastic films which have their outer margins heat-sealed or welded together. The margins of the sheets are draped over and are secured to the periphery of the base of a rigid box and the box can be closed by a separate lid. The fragile article is suspended inside the box by the stretched flexible plastic films.

My earlier U.S. Pat. No. 3,853,220 is directed to a package for a fragile article in which the central, article-enclosing portion of a supporting hammock is formed of thin, flexible thermoplastic material, but the opposite ends of the hammock are secured to rigid legs which, in the preferred embodiment, extend over opposite ends of the base of a rigid outer box. As a lid for the box is telescoped over the base, it engages the legs and swings them downward against the sides of the box base to stretch the flexible hammock extending between the upper parts of the legs.

British Pat. No. 237,322 discloses a package for fragile articles in which the article is inserted into a fabric sleeve which has its opposite end portions twisted and secured to the opposite ends of a rigid box base, such as by snugly fitting the twisted fabric ends in slots or apertures in the ends of the box base.

In the packaging disclosed in Kirkpatrick U.S. Pat. No. 2,956,672, a fragile article to be packaged is inserted into a tube of heat-shrinkable material which has its opposite ends attached to the inner upright sides of a box base by clips or clamps.

SUMMARY OF THE INVENTION

It is an object of the present invention to provide a package for a fragile article in which the article is enclosed by a rigid box and is held out of contact with the box walls, but in a form which does not necessarily require a specially designed package and assembly procedure for each type of fragile article to be packaged.

It also is an object to provide such a package in a form that is simple to use and assemble.

Another object is to provide such a package that can be mass-produced.

A further object is to provide such a package in a form using a minimum of different components.

These and other objects are accomplished by the protective packaging in accordance with the present invention described in detail below.

DETAILED DESCRIPTION

Figure 1:
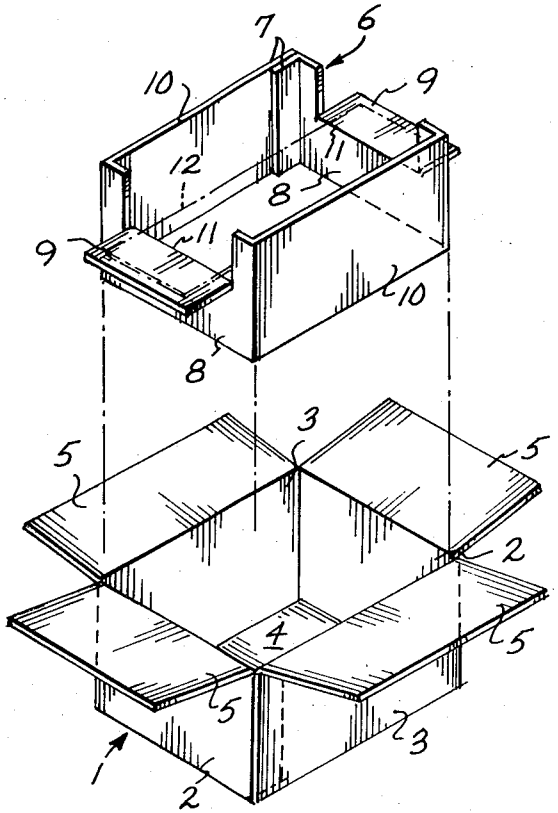
FIG. 1 is a somewhat diagrammatic, exploded, top perspective of two components of protective packaging in accordance with the present invention, namely, a box component and an insert component.

The protective packaging in accordance with the present invention is intended to be used for shipping a wide variety of fragile articles of different sizes and shapes. In the embodiment shown in FIGS. 1, 2 and 3, the packaging includes an outer rigid or substantially rigid box 1, preferably a cardboard box of the type known in the trade as a "slotted container". Such a box has bottom flaps integral with the box end walls 2 and sidewalls 3 which, in the condition shown in FIG. 1, have been folded inward and secured to form the flat box bottom 4. The top flaps 5, which also are integral with the box end walls and sidewalls, have been folded outward so that the top of the box is open.

Figure 2:
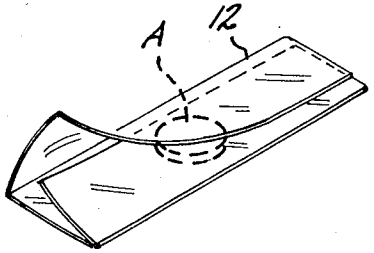
FIG. 2 is a somewhat diagrammatic top perspective of another component of protective packaging in accordance with the present invention for use with the components shown in FIG. 1, namely, the article-supporting cradle or hammock.
Figure 3:
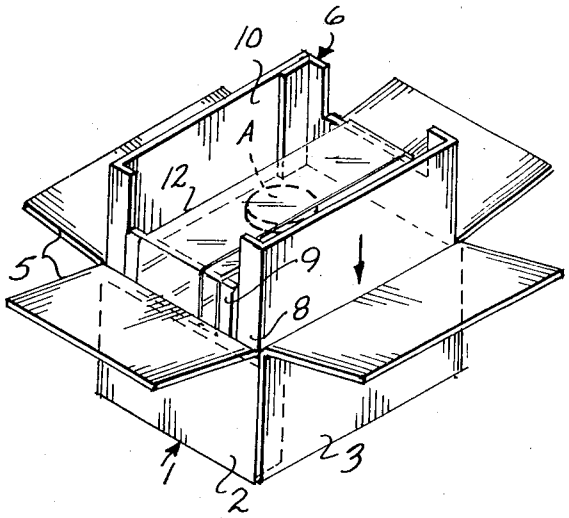
FIG. 3 is a somewhat diagrammatic top perspective of protective packaging in accordance with the present invention using the components shown in FIGS. 1 and 2 with such components shown in partially assembled relationship.

In accordance with the embodiment of the present invention shown in FIGS. 1, 2 and 3, a separate insert 6 is provided to be fitted snugly inside the box 1. Preferably such insert is formed of a single, elongated, rectangular sheet or strip of cardboard material folded into an open topped and open bottomed rectangular ring with the opposite end margins 7 of the insert overlapping and secured together. The height of the insert 6 is approximately the same as the depth of the box 1.

The opposite end walls 8 of the insert have integral upper flaps or tabs 9 that can be bent downward to the condition shown in FIG. 1 in which the tabs project perpendicularly outward from the remainder of the end walls 8 leaving wide open slots extending downward from the tops of such insert end walls. The tabs are centered between the insert sidewalls 10, and their opposite edges are spaced inward slightly from such sidewalls. In addition, preferably the horizontal creases 11 along which the tabs are folded are located approximately midway between the top and bottom of the insert.

With reference to FIG. 2, the fragile article A to be shipped is carried inside an elongated cradle or hammock 12 substantially longer than the distance between the insert end walls 8 and of a width equal to or less than the transverse width of the insert tabs 9. In the form shown in FIG. 2, the article A is simply wrapped inside a sheet of flexible material which can be a net, fabric or strong paper, but which preferably is a flexible thin plastic sheet. Alternatively, the hammock can be a flexible tube into which the article can be inserted. It should be noted that, as used herein, "flexible" means that the hammock can be bent without breaking. It is preferred, however, that the hammock also be of a material which is at least slightly resiliently stretchable.

As indicated in broken lines in FIG. 1, the opposite end portions of the hammock are secured to the upper surfaces of the tabs 9 which have been folded outward. The article A (not shown in FIG. 1) is supported by the hammock substantially centrally of the insert out of contact with its end walls or sidewalls. Next, the tabs 9 are bent downward, which advantageously places the central portion of the hammock under tension. As illustrated in FIG. 3, with the tabs extending vertically downward along the outer sides of the lower portions of the insert end walls, the insert is snugly fitted inside the box 1, whereupon the top flaps 5 can be closed.

The tightness of the central portion of the hammock results in the article being carried securely inside the box but still allows for shock-absorbing action of the hammock as the box is jostled, jolted or even dropped during shipping without the fragile article coming into contact with the box or insert top, bottom, sides or ends.

Figure 4:
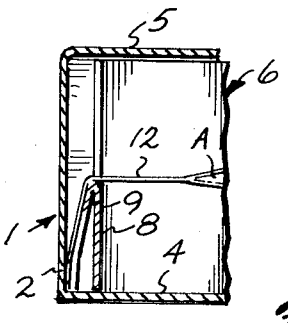
FIG. 4 is a fragmentary, central, longitudinal, vertical section through protective packaging in accordance with the present invention of substantially the same design as the packaging shown in FIGS. 1, 2 and 3, but with a modified insert.

In the form shown in FIGS. 1, 2 and 3, the length of the insert is only slightly less than the length of the box so that, as noted above, the tabs 9 extend vertically downward when the insert is fitted inside the box. As shown in FIG. 4, for additional shock-absorbing action the length of the insert 6 can be substantially less than the length of the box 1 so that the tabs 9 will extend downward and outward at a small acute angle with their bottom edges engaged against the end walls 2 of the box 1 to allow flexing action of the tabs as the box is jostled. In a further modification, the free end portions of the tabs can have spaced scores or creases so that they can be accordion-folded one or more times to act as springs.

Figure 5:
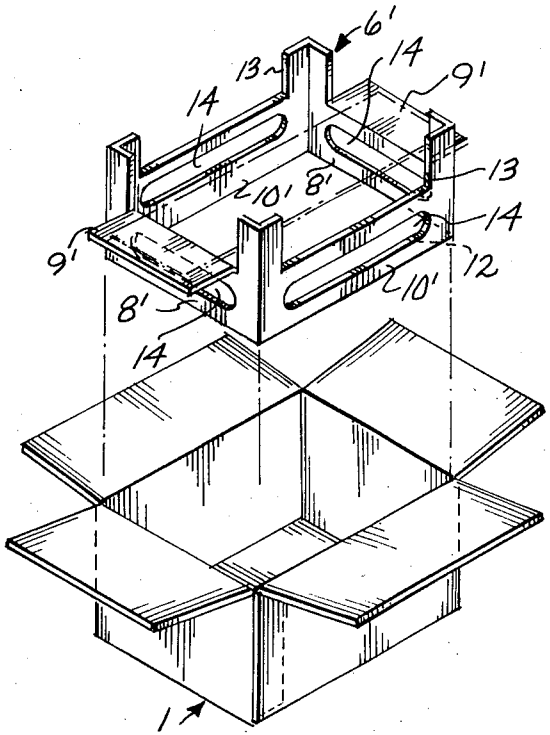
FIG. 5 is a somewhat diagrammatic, exploded, top perspective of another modified form of protective packaging in accordance with the present invention.

In the embodiment shown in FIG. 5, the same type of outer box 1 is used as for the embodiment shown in FIGS. 1, 2 and 3. The insert 6′ shown in FIG. 5, however, is formed of plastic material and has notches 13 cut in the upper portions of the sidewalls 10′ and cutouts 14 in the lower portions of the sidewalls and the end walls 8′ for a saving of plastic material. Preferably, the tabs 9′ still are integral with the remainder of the insert but, depending on the plastic material used, they could be attached to the remainder of the insert by hinges.

Figure 7:
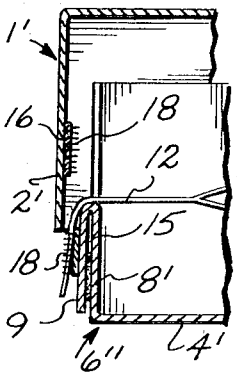
FIG. 7 is a fragmentary, central, longitudinal, vertical section of the packaging shown in FIG. 6 with the parts in partially assembled relationship.
Figure 6:
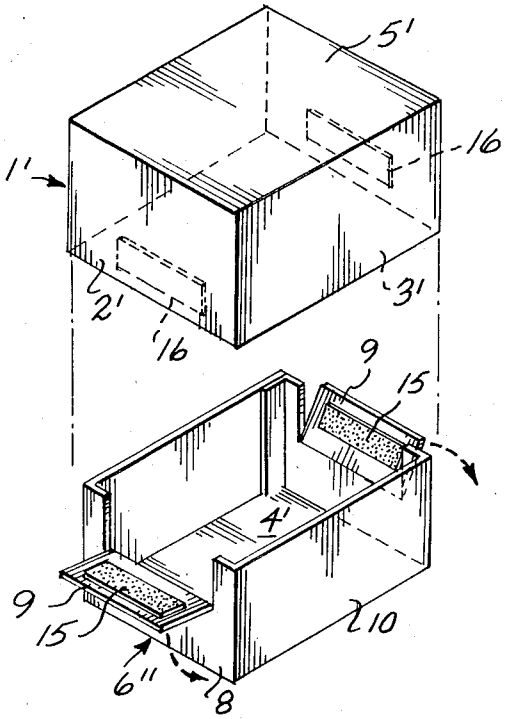
FIG. 6 is a somewhat diagrammatic, exploded, top perspective of yet another form of protective packaging in accordance with the present invention.

In the embodiment shown in FIGS. 6 and 7, the box 1′ is shown somewhat diagrammatically. Preferably such box still is a cardboard slotted container but with its top flaps folded inward to form the box lid 5′ and the bottom flaps deleted so that the box has an open bottom. The insert 6″ is substantially the same as the insert 6 shown in FIG. 1 with the exception that bottom flaps extend downward from the insert end walls 8 and sidewalls 10. Such flaps are folded inward and secured to form a flat bottom 4′.

As seen in FIG. 6, the upper surfaces of the insert tabs 9 can have patches 15 of adhesive material to simplify attachment of the opposite ends of the appropriate article-enclosing cradle or hammock. Similarly, the lower inner margins of the box end walls 2 can have adhesive patches 16 so that when the box is telescoped downward over the insert, separation of the insert and the box will be deterred.

As seen in FIG. 7, such patches 15 and 16 can be plastic or metal material having projecting spikes or pins 18. When the box is telescoped downward over the base, the spikes or pins of the patches 15 and 16 interlock to deter separation of the box and insert components.

For the form of the present invention shown in FIGS. 8 through 11, both the outer box and the insert are formed from a single, precut, foldable box blank 20 which preferably is cardboard. The dot-dash lines indicate fold lines or creases made during the manufacturing of the blank.

Figure 8:
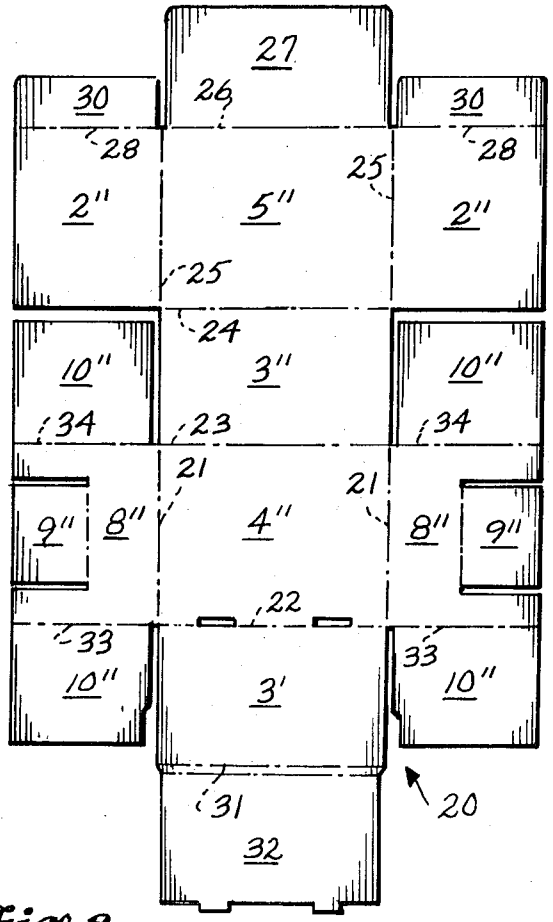
FIG. 8 is a top plan of a foldable box blank usable in still another form of protective packaging in accordance with the present invention.

As shown in FIG. 8, the box blank 20 includes a rectangular bottom section 4″ joined to inner or insert end wall sections 8″ by spaced parallel fold lines 21. Such bottom section also is joined to outer or box sidewall sections 3′ and 3″, respectively, by spaced parallel fold lines 22 and 23, respectively, extending perpendicular to the fold lines 21.

A fold line 24 joins the box lid section 5″ to the edge of the box sidewall section 3″ remote from its fold line 23. Box end wall sections 2″ are joined to the lid section 5″ by fold lines 25 which extend perpendicular to the fold line 24 from generally its opposite ends. A fold line 26 at the edge of the lid section 5″ remote from its fold line 24 joins a top tab 27 to such lid section; and fold lines 28 aligned with line 26 join two short side tabs 30 to the adjacent edges of the box end wall sections 2″.

At the other end of the blank, a double fold line 31 joins a front tab 32 to the edge of the box sidewall section 3′ remote from its fold line 22.

The construction of the box blank is completed by insert sidewall flaps 10″ joined to the opposite sides, respectively, of each insert end wall section 8″ by fold lines 33 aligned with the line 22 or fold lines 34 aligned with the line 23. The insert end wall sections 8″ have the integral, foldable, hammock-supporting tabs 9″.

Figure 9:
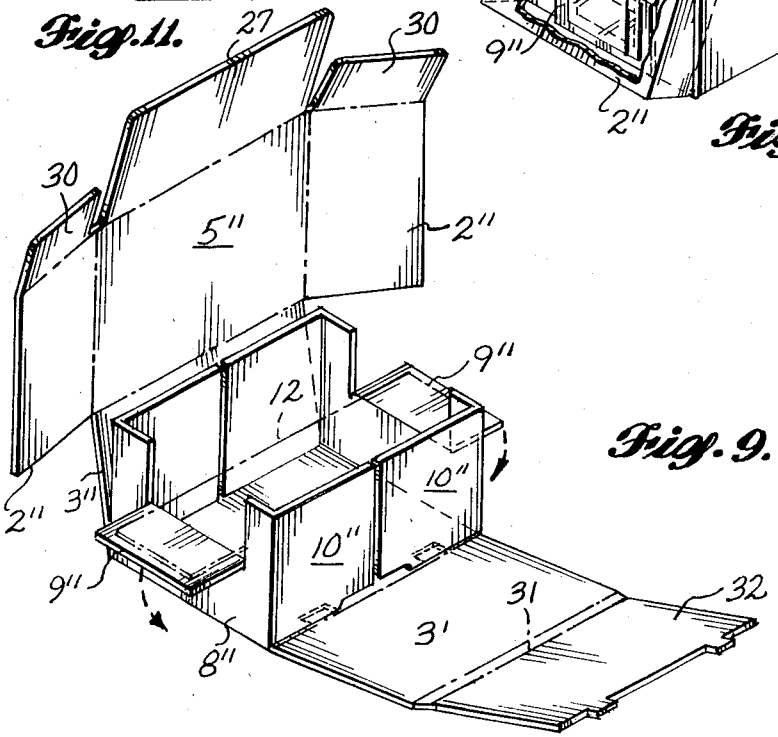
FIG. 9 is a somewhat diagrammatic top perspective of the box blank of FIG. 8 in partially folded condition.

The box blank 20 is folded to the condition shown in FIG. 9 by first bending the inner or insert end wall sections 8″ along the fold lines 21 so as to project perpendicularly upward from the bottom section 4″. To complete formation of the insert portion of the package, the flaps 10″ are bent perpendicularly inward to form the insert sidewalls, and the tabs 9″ are bent perpendicularly outward. Then the box sidewall section 3″ is bent upward along fold line 23 so as to extend vertically behind the rear flaps 10″.

Figure 10:
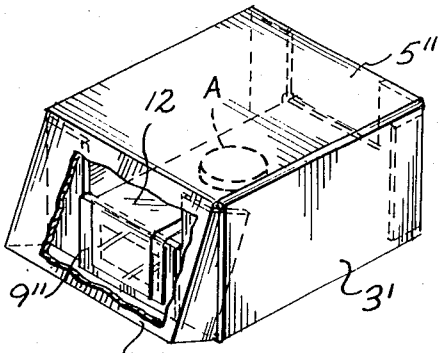
FIG. 10 is a top perspective of the box blank of FIG. 8 in almost completely folded condition with parts broken away to illustrate the article-supporting cradle.
Figure 11:
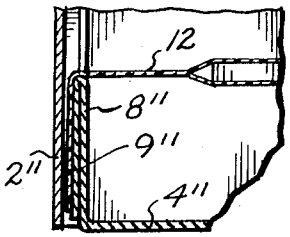
FIG. 11 is a fragmentary, central, longitudinal, vertical section of completed protective packaging in accordance with the present invention using the box blank of FIG. 8.

The front of the package can be completed from the position shown in FIG. 9 by folding the front box sidewall section 3′ upward and return bending the front tab 32 along the double fold line 31 so as to tuck it in along the inner sides of the front insert flaps 10″. In this condition of the blank, a cradle or hammock of any of the types previously described can be inserted into the upward opening notches formed in the upper end portions of the insert end walls 8″ by bending the tabs 9″ outward. The opposite end portions of the hammock are secured to the upper surfaces of such tabs 9″. The top tab 27 is bent forward and tucked inside the return bent front flap 32 as the box lid section 5″ is bent forward. As seen in FIG. 10, the hammock-supporting tabs 9″ are bent downward, placing the central portion of the hammock under tension, as the box sidewall sections 2'' are bent downward and their tabs 30 are tucked between the front box sidewall section 3' and the front insert sidewall flaps 10'' seen in FIG. 9. Consequently, the fragile article A to be shipped is held securely in the center of the completed package out of contact with its top, bottom, sides and ends.

I claim:

1. In protective packaging for a fragile article, such package including a substantially rigid outer box and a hammock for supporting the article inside the box and out of contact with the box, the improvement comprising the packaging including an insert closely fittable inside the box, said insert including opposite upright end walls having slots extending downward from the tops of said upright end walls, respectively, the bases of said slots being located about midway between the tops and bottoms of said end walls, and tabs swingably connected to said insert end walls, respectively, at the bases of said slots, the hammock having opposite end portions fittable in said slots and securable to said tabs, respectively, so that the hammock extends between said tabs and the corresponding insert end walls, each of said tabs being swingable outward and toward the outer side of its end wall so as to tension the central portion of the hammock between said tabs, said insert being proportioned so that said tabs are held in position tensioning the hammock when said insert is fitted inside the box.

2. In the packaging defined in claim 1, the insert having opposite sidewalls extending between the opposite insert ends, and each tab having opposite sides spaced inward from said insert sidewalls, respectively.

3. In the packaging defined in claim 2, the tabs being integral with the insert end walls.

4. In the packaging defined in claim 1, means for deterring separation of the box and the insert after the insert has been fitted inside the box.

5. In the packaging defined in claim 1, both the box and the insert being formed from a single, precut, foldable box blank.

6. A device for holding a fragile article comprising an elongated hammock of flexible sheet material having a central portion for receiving the article, an upright ring of substantially rigid material having opposite end portions spaced apart, said opposite end portions of said upright ring having slots extending downward from the tops of said end portions, the bases of said slots being located about midway between the top and bottom of said insert, means for attaching the opposite end portions of said hammock to said opposite end portions of said ring with said hammock extending between said ring end portions so as to maintain the article inside said ring, at least one of said end portions of said ring having a tab pivotally connected to and carried by the remainder of such end portion at the base of its slot, said attaching means including means for attaching one end portion of said hammock to said tab, said tab being swingable relative to the remainder of its ring end portion after attachment of said hammock from a position projecting outward from the remainder of its ring end portion to a tensioning position closely adjacent to the outer side of the remainder of its ring end portion so as to tension said hammock, and means for retaining said tab in is tensioning position.

7. A device for holding a fragile article comprising an elongated hammock of flexible sheet material having a central portion for receiving the article, an upright ring of substantially rigid material having top and bottom edges and opposite upright end portions spaced apart, each of said end portions of said ring having a tab integral with the remainder of such ring end portion and foldable relative to the remainder of such end portion into substantially return-bent condition so as to place such tab and the remainder of its end portion in substantially face-to-face contact and so as to form an open slot extending from one of said edges of said insert, means for retaining said tabs in their return-bent conditions, and means for attaching the opposite end portions of said hammock to the opposite end portions of said ring with said hammock extending between said ring end portions and over the return-bent portions of said tabs so as to maintain the article inside said ring.

8. The device defined in claim 7, in which the ring is formed from a single, precut, foldable box blank.

9. The device defined in claim 7, in which the attaching means includes means for attaching the opposite end portions of the hammock to the tabs, the tabs being swingable outward, after attachment of the hammock, to respective tensioning positions closely adjacent to the outer sides of the remainders of the ring end portions.

10. A device for holding a fragile article comprising an elongated hammock of flexible sheet material having a central portion for receiving the article, an upright ring of substantially rigid material having top and bottom edges and opposite end portions spaced apart, and means for attaching the opposite end portions of the hammock to the opposite end portions of the ring with the hammock extending between the ring end portions so as to maintain the article inside the ring, each end portion of said ring having a tab integral with the remainder of such ring end portion and foldable relative to the remainder of such end portion into substantially return bent condition so as to place such tab and the remainder of its end portion in substantially face-to-face contact and so as to form open slots extending from one to said edges of said insert for receiving the opposite end portions of said hammock, and means for retaining said tabs in their return bent conditions.

11. The device defined in claim 10, in which the ring is formed from a single, precut, foldable box blank.

* * * * *